United States Patent [19]

Cherry et al.

[11] Patent Number: 4,613,223

[45] Date of Patent: Sep. 23, 1986

[54] METHOD OF AND APPARATUS FOR TREATING WITH A LIQUID A SHEET OF FLEXIBLE PHOTOGRAPHIC MATERIAL HAVING A PHOTOGRAPHIC EMULSION ON ONE FACE THEREOF

[75] Inventors: Peter J. Cherry, Lancaster; Barrie A. Freeman, Wilmslow, both of England

[73] Assignee: Ciba-Giegy AG, Basel, Switzerland

[21] Appl. No.: 713,130

[22] Filed: Mar. 18, 1985

[30] Foreign Application Priority Data

Mar. 29, 1984 [GB] United Kingdom ..... 8408055

[51] Int. Cl.[4] ..... G03D 3/08

[52] U.S. Cl. ..... 354/322; 354/316; 354/338

[58] Field of Search ..... 354/307, 312, 316, 320, 354/321, 322, 329, 330, 338

[56] References Cited

U.S. PATENT DOCUMENTS

| | | | |
|---|---|---|---|
| 2,940,584 | 6/1960 | Kunz | 354/322 |
| 3,673,985 | 7/1972 | Dols | 354/329 |
| 3,741,093 | 6/1973 | Kormori et al. | 354/321 |
| 4,439,033 | 3/1984 | Freeman | 354/322 |
| 4,444,480 | 4/4984 | Freeman | 354/329 |

FOREIGN PATENT DOCUMENTS

| | | | |
|---|---|---|---|
| 484431 | 6/1975 | Australia . | |
| 0078770 | 5/1983 | European Pat. Off. | 354/321 |
| 1497496 | 7/1969 | Fed. Rep. of Germany . | |
| 2414824 | 10/1974 | Fed. Rep. of Germany . | |
| 2615932 | 10/1977 | Fed. Rep. of Germany . | |
| 3209262 | 9/1983 | Fed. Rep. of Germany . | |

*Primary Examiner*—A. A. Mathews
*Attorney, Agent, or Firm*—Harry Falber

[57] ABSTRACT

A method of and apparatus for treating with a liquid a sheet of flexible photographic material having a photographic emulsion on one face thereof are described. The sheet of photographic material is introduced into a processing vessel (2) from above the liquid in the vessel and into the liquid with the other face of the photographic material directed to the inner wall of the vessel and the emulsions surface directed to the interior of the vessel. The sheet is driven along a curved endless path within the vessel by passing the sheet through the nips between at least one pair of driven rollers (9 and 12, 13 and 14) and is guided so as substantially to follow the inside wall of the vessel (8) during its passage through the liquid, whereby the emulsion surface cannot come into contact with a stationary part of the vessel and will not therefore be damaged during the treatment in the liquid. The driving and guiding are carried out for sufficient time for the treatment to be completed, whereupon the sheet is removed from the vessel through an outlet comprising a pivotably mounted guide member (17).

9 Claims, 4 Drawing Figures

Figure 1:
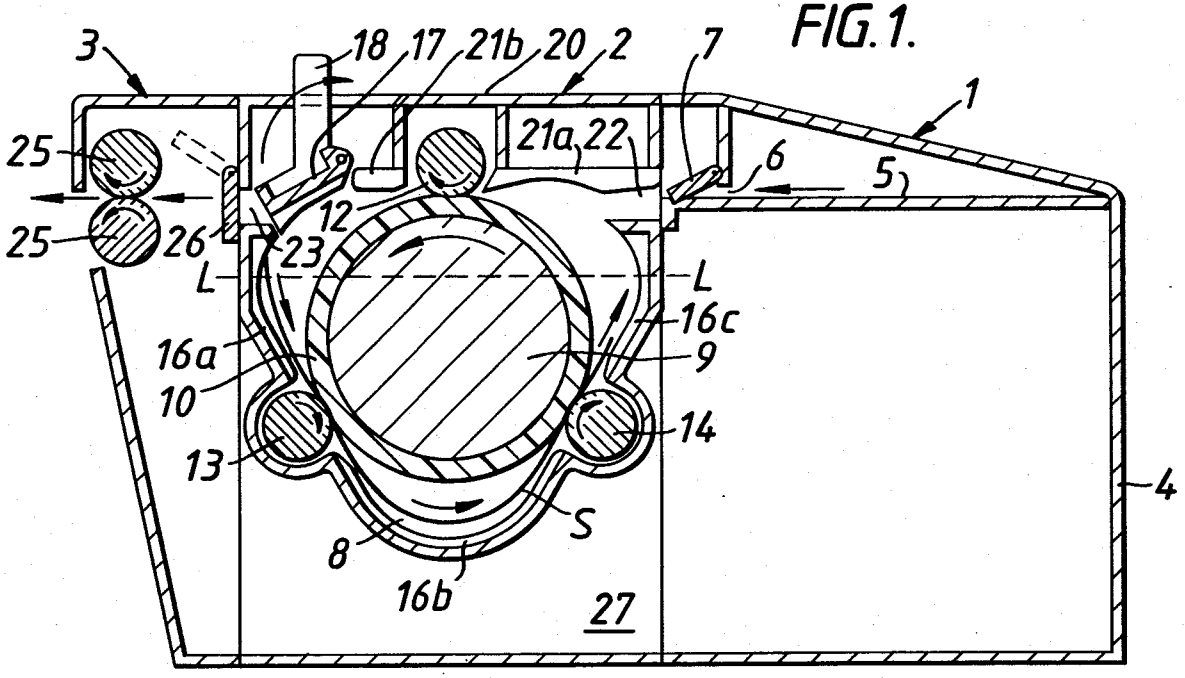

METHOD OF AND APPARATUS FOR TREATING WITH A LIQUID A SHEET OF FLEXIBLE PHOTOGRAPHIC MATERIAL HAVING A PHOTOGRAPHIC EMULSION ON ONE FACE THEREOF

This invention relates to photographic processing apparatus, and to a method of processing photographic sheet material.

In the past photohobbyists and professional photographers who have processed their own prints have had to use processing dishes and have had to move the print continuously or intermittently in the dish to ensure that the print is processed uniformly. Often development processes require one to two minutes or even longer and fixing times can be just as long Photographic processing houses who handle hundreds of prints per hour have very long processing tanks through which the prints can be fed to develop or fix the print in the requisite time, the action of passing the print through the solution causing fresh solution to come continuously into contact with the print surface. However, it is not practical for a photohobbyist or professional photographer who wishes to process only his own prints to have such a processing machine because its large size is dependent upon the length of processing time required and on the rate at which prints are to be processed.

In a number of prior art processing machines as described in patent specifications, photographic material is fed through a processing machine in which a drum is rotating in the processing liquid and the photographic material is caused to adhere to the outside of the drum for part of a full rotation of the drum in the liquid. Examples of such patent specifications are DE-OS No. 1497496 and DE-OS No. 2615932. However in such proposed machines the material would not be in contact with the processing liquid for sufficient time for the process to be fully carried out.

However in DE-OS No. 2414824 there is described an apparatus in which a photographic film is caused to adhere to the surface of a drum which rotates in a bath of a processing liquid and to rotate with the drum for a sufficient length of time for the process to be completed. At the end of the treatment period, liquid jet knives are used to strip the photographic material from the surface of the drum. A simpler method of stripping the sheet of photographic material from the surface of a drum in a similar processing apparatus is described in our European Patent Application No. 78770. However both in the apparatus of DE-OS No. 2414824 and in the apparatus of EP No. 78770 the sheet of photographic material is passed around in contact with the surface of the central rotating drum so that the emulsion surface is outwards, the material being held in place on the drum by a system of rollers arranged around the periphery of the drum. In this connection, as a length of the photographic material tends to curl with the emulsion surface inside, a plurality of rollers is required around the periphery of the drum to ensure that the material closely follows the drum. It has been found that when using such processing apparatus the emulsion surface tends to get marked both by physical contact with the array of peripheral rollers and also due to uneven processing; streaks often being found on the photographic material after processing.

Another apparatus for developing photographic material is described in DE-OS No. 3209262 and consists of a plurality of baths which are arranged consecutively so that a part of the process for the complete colour development of an image takes place in each bath. In each bath the photographic material is guided in a circle by a plurality of pairs of transport rollers arranged in a circle with guide combs stationarily mounted between the pairs of rollers so as to direct the photographic material, which has passed between one pair of rollers, into the nip between the next pair of rollers. The photographic material may be guided by the rollers and guide combs to follow a circular path and the emulsion surface may be on the inside or the outside or, alternatively, two sheets of material may be passed through simultaneously in back-to-back relation. However, in each case the guide combs are so arranged that in order to guide the photographic material in the desired manner, the wet emulsion surface will contact to a greater or lesser extent the stationary guide combs and is thus liable to be damaged.

It is an object of the present invention to provide a method of and apparatus for treating with a liquid a sheet of flexible photographic material having a photographic emulsion on one face thereof, particularly for photohobbyists, in which it is possible to develop photographic material without damaging the material by contact with stationary parts or excessive contact with rollers. The invention may also be arranged to provide for adequate development using a relatively small amount of developing liquid so that it becomes very economic for use by a photohobbyist.

According to one aspect of the present invention there is provided a method of treating with a liquid a sheet of flexible photographic material having a photographic emulsion on one face thereof, which comprises introducing the sheet of photographic material into a processing vessel from above the liquid in the vessel and into the liquid with the other face of the photographic material directed to the inner wall of the vessel and the emulsion surface directed to the interior of the vessel, driving the sheet along a curved endless path within the vessel by passing the sheet through the nips between at least one pair of driven rollers, guiding the sheet substantially to follow the inside wall of the vessel during its passage through the liquid so that the emulsion surface does not come into contact with a stationary part of the vessel, the driving and guiding being carried out for sufficient time for the treatment to be completed, and removing the sheet from the vessel so that the emulsion surface does not come into contact with a stationary part of the vessel.

According to another aspect of the present invention there is provided apparatus for treating with a liquid sheets of flexible photographic material having a photographic emulsion on one face thereof, comprising a vessel for holding the liquid, guide members associated with the inner wall of the vessel and shaped to define a curved endless path within the vessel, an inlet to said vessel for introducing a sheet of photographic material into the vessel and along said path, an outlet from said vessel for a treated sheet, said outlet comprising a pivotably mounted guide member, at least one roller pair providing at least one roller nip and means for driving at least one of the rollers of the or each pair; the guide members and roller nip(s) being so arranged and shaped that when a sheet of photographic material is introduced into liquid in the vessel so that its emulsion face is directed to the interior of the vessel, the sheet can be driven along said path such that its emulsion surface cannot come into contact with a stationary part of the vessel.

In carrying out the present method a sheet of flexible photographic material having a photographic emulsion on one face thereof is fed into the processing vessel above the level of the liquid and emulsion face downwards into the nip between a pair of rollers which drive the sheet around the inside walls of the vessel so that its emulsion surface faces towards the centre of the vessel where it cannot contact any stationary part of the vessel. The sheet is driven around the vessel for sufficient time for the process to be completed and is then ejected from the vessel through a pivotable portion of the guiding system above the level of the liquid.

In the simplest embodiment of the present apparatus, the apparatus comprises a vessel into which the sheet can be fed so that it enters the nip between two rotatable rollers, one being a central roller and the other being a peripheral roller which engages the central roller and the axis of which is mounted above that of the central roller. The guide system formed by the guide members in the vessel is so located and shaped that the leading edge of the photographic material after leaving the pair of nip rollers forms a loop which leads back to the pair of nip rollers, either one or both of the pair of nip rollers being a driven roller, and part of the guide system which is above the level of the liquid in the vessel being pivotably mounted to open to allow the sheet of photographic material to be guided out of the vessel when the said part of the guide system is in the open position.

This embodiment, however, can be used to process satisfactorily only sheet material of limited length as one part of the length of sheet material must always be acted on by the pair of nip rollers to enable a continuous traverse of the sheet material around the vessel to be maintained.

Preferably the lower roller of the nip pair has a soft skin and the upper roller of the nip pair has a hard skin.

In a further embodiment of the present apparatus there are several pairs of rollers arranged along the path, each pair comprising an inner roller and a peripheral roller and each pair providing a respective nip. In this embodiment the sheet is fed into the vessel so that it enters the nip between two rotatable rollers one mounted above the other, there being present in the vessel arranged around the internal periphery thereof at least one other pair of nip rollers. The guide members associated with the walls of the vessel are so located and shaped that the sheet of photographic material after leaving the first pair of nip rollers is guided towards the nip of the next pair of rollers through which it passes in its passage around the inside wall of the vessel. At least one roller of each pair of nip rollers is a driven roller, and one part of the guide system which is above the level of the liquid in the vessel is pivotably mounted to open to allow the sheet of photographic material to be guided out of the vessel when the said part of the guide system is open.

Preferably there are two, three or four pairs of nip rollers in the vessel. Most preferably each roller in the system is a driven roller.

Preferably each inner roller, that is to say the rollers the faces of which are in contact with the emulsion side of the sheet, are covered with a soft skin and most preferably comprise a sleeve of foam material with a closed cell surface. Preferably each of the other rollers of the pair has a hard surface.

In each of these embodiments the guide system is conveniently so shaped that the inside configuration of the vessel and thus the curved endless path are substantially circular.

In a preferred embodiment of the present apparatus, a central roller is provided in the vessel and is engaged by a plurality of peripheral rollers each providing together with the central roller a respective roller nip. In this embodiment, the guide members approach the central roller in the region of each of the nips and recede therefrom between the nips to form pockets for receiving the liquid. Thus, in this embodiment the sheet is fed so that it enters the nip between the central rotatable roller and a peripheral roller mounted above it. The guide members are so located and shaped that the sheet of photographic material after leaving the first pair of nip rollers is allowed to loop away from the surface of the central roller in a pocket but is guided back to the next nip through which it passes on its passage around the central roller, the nip being formed by the central roller and another peripheral roller. The central roller may be a driven roller and/or each peripheral roller may be a driven roller, and again one guide member which is above the level of the liquid in the vessel is pivotably mounted to open to allow the sheet of photographic material to be guided out of the vessel when the said guide member is in the open position. Preferably there are two, three or four peripheral rollers grouped around the periphery of the central roller which is of greater diameter than the peripheral rollers.

Preferably each of the rollers in the vessel is a driven roller. Conveniently the rollers may be connected by a gear system so that there is only one driving shaft.

Preferably the central roller has a soft skin and most preferably the skin of the roller consists of a sleeve of soft foam plastics material with a closed cell surface so that the skin is soft but does not absorb liquid. Other materials for forming the surface of the central roller include plastics material and rubber, either of which may be hard or soft.

The peripheral rollers are conveniently of solid polyvinyl chloride or other plastics material, or composed of a metal, such as stainless steel, which will not corrode in the processing solution. Alternatively, each roller may be a metal rod covered with a sleeve of a plastics material or rubber. Preferably the surface of the or each peripheral roller is a hard surface.

The arc distance between each peripheral roller around the periphery of the central roller is dependent upon the minimum length of the photographic sheets to be processed.

It is important that the peripheral rollers should not be grouped together too closely otherwise the photographic sheet will not be able to loop away from the central roller and it is an important feature of this embodiment of the present apparatus, when in use, that the photographic sheet being processed should loop away from the central roller to enable its emulsion surface to be exposed to as much processing liquid as possible because the sheet is fed into the apparatus so that the emulsion surface faces the central roller and is taken around this roller but is only in contact with this roller when this roller forms a nip pair with the peripheral rollers.

The continuous forming of a loop causes the sheet to ebb and flow towards and away from the surface of the central roller and this causes a certain agitation in the processing solution which allows fresh solution to be continually in contact with the emulsion surface of the sheet. This, together with the squeegeeing effect of the nip rollers, provides very even processing condition for the photographic sheet.

In all the embodiments the sheet of photographic material is driven around the vessel into and out of the liquid for sufficient time for the process or washing, e.g. development or fixing to take place and then the pivotable guide is opened and the next time the leading edge of the sheet passes this guide it is guided out of the apparatus.

Thus, in the operation of the apparatus the sheet of photographic material is guided into the vessel, which contains the processing solution or wash water, above the liquid into the top pair of nip rollers emulsion surface downwards. The driven rollers or rollers are then caused to rotate for sufficient length of time for the processing step which is to be performed or the washing in the apparatus to be completed. In one embodiment the number of revolutions of the driven rollers required to occupy this time are preset on a revolution counter and the rollers continue to rotate in the vessel with the sheet of photographic material taken around the internal periphery of the vessel. When the preset number of revolutions on the revolution counter attached to the driven rollers has been accomplished, the revolution counter causes a mechanism to open the pivotable guide in the vessel and the sheet to be guided out of the vessel.

Alternatively, manual opening of the pivotable part of the vessel can be employed to cause the sheet to be ejected after a preset time.

If desired, an electronic timer may be arranged to actuate a solenoid device which opens the pivotable guide member causing the sheet to be ejected after a preset time.

The present apparatus may be provided in the form of a process module and a feed module may be provided for feeding the photographic sheet material to the process module and a sheet ejection module may be provided for receiving the treated sheet material from the process module. With this arrangement of the apparatus it is possible to provide a processing system comprising a plurality of the process modules connected in series between a feed module and a sheet ejection module. Thus, a photographic process system may comprise four such process modules, of which, for example, the first may contain photographic developer and a print may require one minute processing therein, the second may contain an acid stop bath and require 20 seconds processing, the third may contain a fixing solution and require one minute processing and the fourth may be a washing apparatus and require one minute to complete the wash.

This embodiment of the present apparatus may also be used for colour processing and in one well known colour process three process baths are required, the dwell time in each bath being three minutes.

Figure 2:
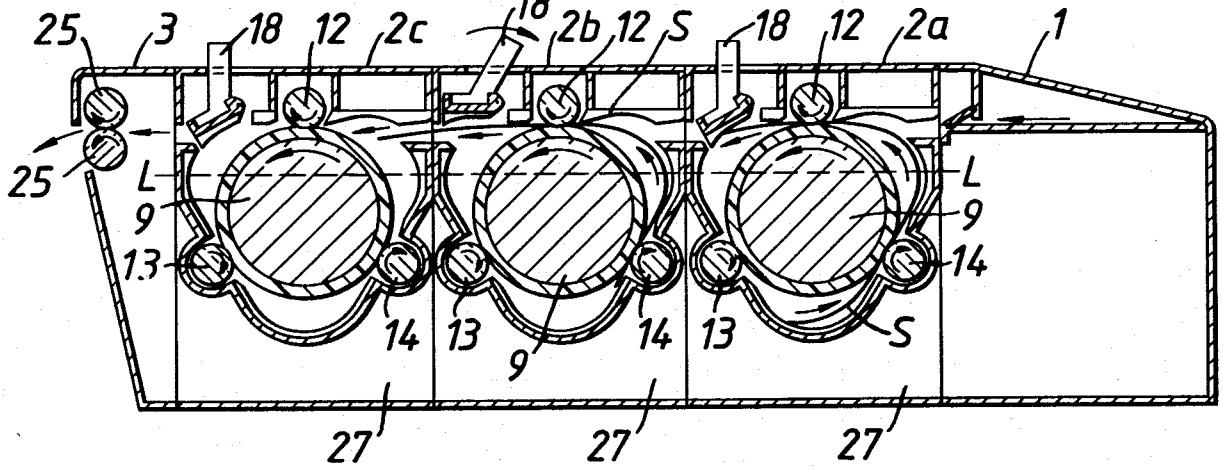
Figure 3:
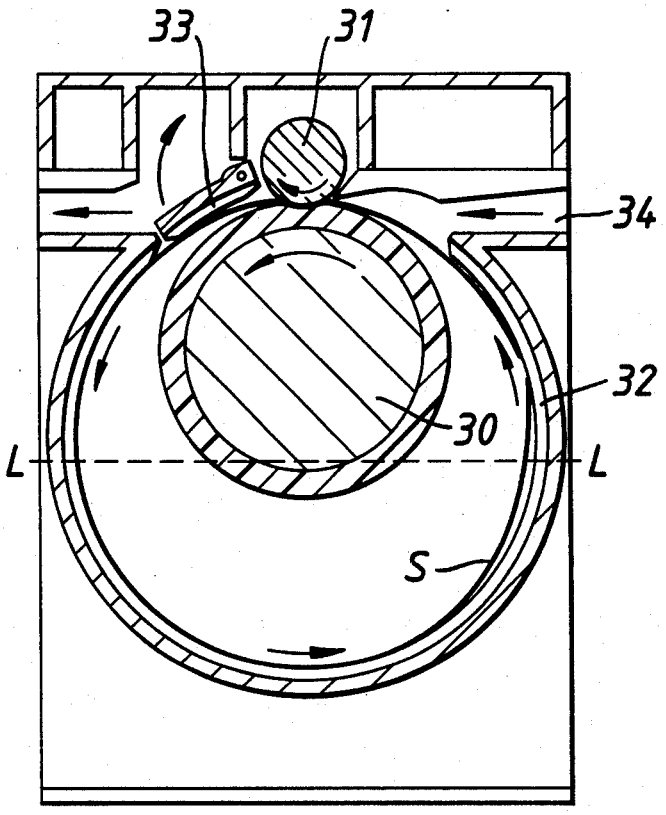
Figure 4:
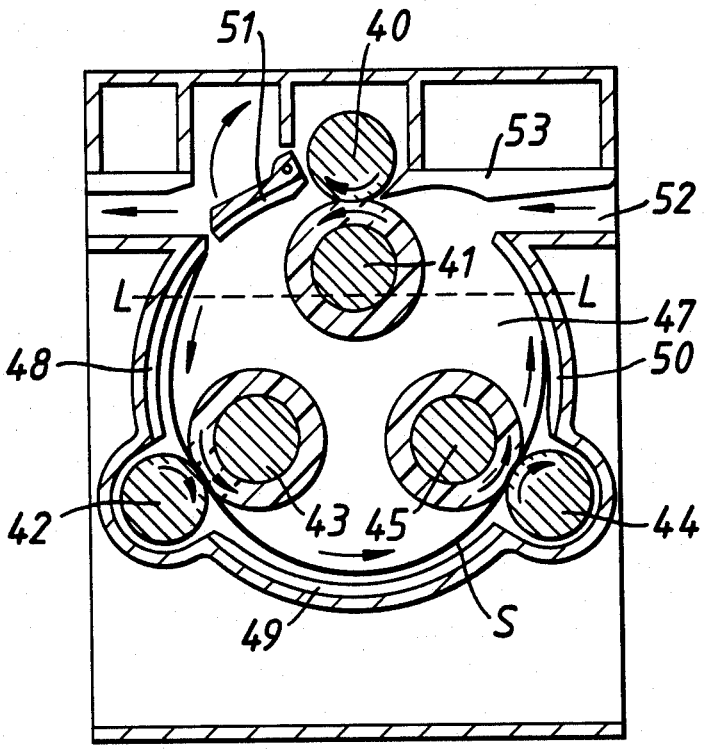

In order to enable the invention to be more readily understood, reference will now be made to the accompanying drawings, which illustrate diagrammatically and by way of example some embodiments thereof, and in which:

FIG. 1 is a cross-sectional side elevation of a processing apparatus according to the present invention and comprising a feed module, a process module and a sheet ejection module, FIG. 2 is a cross-sectional side elevation of a processing system which comprises three of the process modules shown in FIG. 1, FIG. 3 is a cross-sectional side elevation of a modified process module, and, FIG. 4 is a cross-sectional side elevation of a further modified process module.

Referring now to FIG. 1, there is shown a processing apparatus for use in developing an exposed flexible photographic material by treating it with a fixing and developing liquid. The apparatus shown in FIG. 1 comprises a feed module 1, a process module 2 and a sheet ejection module 3. The modules 1, 2 and 3 are held together by a suitable coupling mechanism (not shown).

The feed module 1 consists of a stand 4 supporting a raised tray 5 in which a sheet of photographic material S is rested prior to feeding it into the process module 2 through a slot 6 which is normally covered by a pivotable light trap 7.

The process module 2 comprises a raised liquid tight vessel 8 in which is mounted a central roller 9 which is covered with a sleeve 10 of soft closed cell foam plastics material. Arranged around the periphery of roller 9 are three driven PVC rollers 12, 13 and 14. The four rollers are connected together by gearing in such a manner (not shown) that the peripheral speeds of the rollers at the nips between the rollers are the same. All the rollers are driven by a single driving shaft and rotate in the directions shown by the arrows.

The rollers 12, 13 and 14 are so mounted in relation to the roller 9 that their surfaces press into the soft skin of roller 9 as shown.

Attached to the side walls of the vessel 8 are a series of curved guides 16*a*, 16*b* and 16*c*. A pivotable guide member 17 having a handle 18 which protrudes through the top wall 20 of the module 2 is mounted above the guide 16*a* and is pivotable in the direction indicted by the arrow from the closed position shown in FIG. 1 to an open position. It will be seen that the guides approach the central roller 9 in the region of each of the nips and recede from the roller between the nips thereby to form pockets in which the liquid is received. It will be appreciated that these pockets can be made of a desired size so that the apparatus is capable of dealing with a large amount of sheet material or a small amount.

Attached to the underside of the top wall 20 are two further guide members 21*a* and 21*b*. The guide member 21*a* forms with the end of the guide 16*c* an entry port 22 which communicates with the slot 6. An exit port 23 on the other side of the vessel 8 is uncovered when the guide member 17 is pivoted into the open position.

The sheet ejection module 3 comprises a pair of driven nip rollers 25 and a pivotable light trap 26 mounted to cover the exit port 23 when in the closed position.

In the operation of the apparatus just described, the vessel 8 is filled with liquid to the height L—L and the rollers 9, 12, 13 and 14 are caused to rotate. A sheet S of photographic material is laid on the tray 5 emulsion face down and is fed by hand through the slot 6 past the light trap 7 into the entry port 22 of vessel 8, being guided by the guide 21*a* which is contacted by the emulsion-free back of the photographic material, into the nip formed between the rollers 9 and 12. These rotating rollers act on the sheet, pulling it off the tray 5 and moving it forward so that the leading edge contacts the guides 21*b* and 17 and is guided into a loop by these guides so that the sheet is driven into the liquid held in a pocket. The guide 16*a* then turns loop back towards roller 9 so that the leading edge of the sheet S is guided into the nip formed between the rollers 9 and 13. This pair of rollers will then act on the sheet S driving it forward to follow closely the guide 16*b* so as to form a loop, the leading edge of which is guided through the lowest pocket to the nip formed between the rollers 9 and 14. This is the position of the sheet S as shown in FIG. 1. The rollers 9 and 14 then drive the sheet to pass along the guide 16*c* and then out of the liquid so that the leading edge engages the guide 21*a* and is guided into the nip formed between rollers 9 and 12. This nip will squeegee off most of the surface liquid on the emulsion surface of the sheet so it is submersed under the liquid practically dry and takes up entirely fresh solution.

The sheet S is driven around the roller 9 by the nips formed between the roller 9 and the rollers 12, 13 and 14 so as substantially to follow the inside wall of the vessel 8 with the emnulsion surface facing inwards so that it cannot come into contact with any stationary part of the vessel. The sheet is driven several times around the roller 9 into and out of the liquid. As it passes each nip, liquid is squeegeed out of the emulsion surface so that fresh solution is continually presented to the emulsion surface. It will be noted that the path the sheet moves along does not follow the periphery of the roller 9, and indeed such a path would be disadvantageous as the emulsion surface would contact the periphery of the roller 9 and could not come into adequate contact with the liquid. Instead, the path comprises loops which recede from and approach the roller 9 as it passes through a pocket. This causes some agitation in the liquid and on the emulsion surface of the sheet S.

When the sheet S has remained in the vessel 8 for a preset length of time the handle 18 is pulled in the direction shown. This action opens the guide and may also serve to open the light trap 26. Thus the next time the sheet S passes the nip formed between the rollers 9 and 12, instead of being guided by the guide 17 to loop down towards the guide 16*a*, it is guided by the opened guide 17 to the exit port 23 past the opened light trap 26 and into the nip rollers 25 which are caused to rotate and feed the sheet out of the apparatus. It is then substantially dry having just passed through the nip between the rollers 9 and 12.

FIG. 2 shows a processing system comprising a feed module 1, three process modules 2*a*, 2*b* and 2*c* and a sheet ejection module 3, the modules being as described above.

There is colour processing solution in each process module and the dwell time for the photographic material in each module is, for example, three minutes. After every three minutes each handle 18 is pulled to open the associated guide 17 and allow the sheet S either to leave the system or to move to the next process module. The handles 18 are then pushed to close each guide 17 and allow the processing to continue.

In FIG. 2 a sheet S is shown being guided round inside the process module 2*a* and a sheet S is shown being guided from the process module 2*b* into the process module 2*c*.

In the process module 2 shown in FIG. 1 or 2, there is an open space 27 below the vessel 8 and hot water or hot air can be circulated in this space to keep the liquid L at an even elevated temperature. Alternatively, an immersion heater may be present in the bottom of the vessel 8 in contact with the liquid.

In one specific embodiment of the process module shown in FIG. 1, the di>meter of the central roller 9 was 80 mm. and its length was 440 mm.; the speed of rotation of this roller was 12 r.p.m. An apparatus of this type would be suitable for processing photographic material from 13×10 cm. to 30×40 cm.

Referring now to FIG. 3, there is shown a modification of the process module shown in FIGS. 1 and 2. In this modification the roller 9 and peripheral rollers 12, 13 and 14 are replaced by a foam covered roller 30 and one peripheral rolls 31 with a hard skin and with its axis located above that of the roller 30. A sheet of photographic material S, which enters the module through an entry slot 34, is shown guided into a loop by a circular track 32. After the photographic material has been treated for a predetermined time, a pivotable part of the guide 33 is raised and the material can be passed to a sheet ejection module.

The module shown in FIG. 3 has a simple roller configuration and is used in just the same way as the module shown in FIG. 1. However, it can only be used for sheets of photographic material of limited size as one part of the sheet must acted on by the rollers 30 and 31 to ensure that the driving is continuous.

FIG. 4 shows a further modification of the process module in the roller 9 and peripheral rollers 12, 13 and 14 of the module shown in FIG. 1 are replaced by three foam covered rollers 41, 43 and 45 each engaged by a peripheral roller 40, 42 and 44 respectively to form three roller nips arranged equidistantly around the internal periphery of a vessel 47.

All the rollers are driven together by a single driving shaft (not shown). The rollers 41, 43 and 45 are covered with a soft form sleeve, while the rollers 40, 42 and 44 have a hard surface.

Guides 48, 49 and 50 together with a pivotable guide 51 are so shaped that the internal configuration of the vessel is substantially cylindrical and so that the sheet S of photographic material will substantially follow the inside wall of the vessel. An entry port 52 into the vessel is formed by the guide 50 and the guide 53.

The operation of the process module shown in FIG. 4 is essentially the same as that of the process module shown in FIG. 1.

A sheet S of photographic material with its emulsion face towards the centre of the vessel 47 is shown in its passage around the internal periphery of the vessel, the vessel being filled with liquid to the level L—L. A feed module 1 and a sheet ejection module 3 as shown in FIG. 1 can be fitted in like manner to vessel 47.

A sheet of photographic material is guided round the internal periphery of vessel 47 until the process to be carried out in this vessel is complete. The pivotable guide 51 is then opened to eject the sheet S from the vessel 47.

We claim:

1. A method of treating with a liquid a sheet of flexible photographic material having a photographic emulsion on one face thereof, which comprises introducing the sheet of photographic material into a processing vessel from above the liquid in the vessel and into the liquid with the other face of the photographic material directed to the inner wall of the vessel and the emulsion surface directed to the interior of the vessel, driving the sheet along a curved endless path within the vessel by passing the sheet through the nips between at least one pair of driven rollers, guiding the sheet substantially to follow the inside wall of the vessel during its passage through the liquid so that the emulsion surface does not come into contact with a stationary part of the vessel, the driving and guiding being carried out for sufficient time for the treatment to be completed and removing the sheet from the vessel so that the emulsion surface does not come into contact with a stationary part of the vessel.

2. A method as claimed in claim 1, wherein the sheet of photographic material is passed in turn through each of a plurality of said processing vessels arranged in series.

3. Apparatus for treating with a liquid sheets of flexible photographic material having a photographic emulsion on one face thereof, comprising a vessel for holding the liquid, guide members associated with the inner wall of the vessel and shaped to define a curved endless path within the vessel, an inlet to said vessel for introducing a sheet of photographic material into the vessel and along said path, an outlet from said vessel for a treated sheet, said outlet comprising a pivotably mounted guide member, at least one roller pair providing at least one roller nip and means for driving at least one of the rollers of the or each pair; the guide members and roller nip(s) being so arranged and shaped that when a sheet of photographic material is introduced into liquid in the vessel so that its emulsion face is directed to the interior of the vessel, the sheet can be driven along said path such that its emulsion surface cannot come into contact with a stationary part of the vessel.

4. Apparatus as claimed in claim 3, wherein a central roller is provided in the vessel and is engaged by a peripheral roller the axis of which is located above that of the central roller, said rollers providing a roller nip, and wherein the guide members are spaced from the periphery of said central roller and the length of said path is substantially the length of a sheet of photographic material which can be treated in the apparatus.

5. Apparatus as claimed in claim 3, wherein a central roller is provided in the vessel and is engaged by a plurality of peripheral rollers each providing together with the central roller a respective roller nip, and wherein the guide members approach the central roller in the region of each of said nips and recede therefrom between said nips to form pockets for receiving said liquid.

6. Apparatus as claimed in claim 5, wherein there are three peripheral rollers each of smaller diameter than the central roller.

7. Apparatus as claimed in claim 3, wherein there are several pairs of rollers arranged along said path, each pair comprising an inner roller and a peripheral roller and each pair providing a respective nip.

8. Apparatus as claimed in claim 3 wherein the apparatus is provided in the form of a process module, and wherein a feed module and sheet ejection module are connected to the process module for feeding photographic sheet material to and receiving it from the process module.

9. Apparatus as claimed in claim 8, wherein a plurality of said process modules is connected in series between a feed module and a sheet ejection module, so that a sheet can pass in turn through each module.

* * * * *